US009523538B2

(12) United States Patent
Okonski, Jr. et al.

(10) Patent No.: US 9,523,538 B2
(45) Date of Patent: Dec. 20, 2016

(54) HIGH-EFFICIENCY ENHANCED BOILER

(76) Inventors: John E. Okonski, Jr., Niskayuna, NY (US); John E. Okonski, Sr., Niskayuna, NY (US)

( * ) Notice: Subject to any disclaimer, the term of this patent is extended or adjusted under 35 U.S.C. 154(b) by 1274 days.

(21) Appl. No.: 13/003,121

(22) PCT Filed: Jul. 7, 2008

(86) PCT No.: PCT/US2008/069292
§ 371 (c)(1),
(2), (4) Date: Jan. 7, 2011

(87) PCT Pub. No.: WO2010/005422
PCT Pub. Date: Jan. 14, 2010

(65) Prior Publication Data
US 2011/0108238 A1 May 12, 2011

(51) Int. Cl.
*F28D 7/02* (2006.01)
*F28F 1/42* (2006.01)
(Continued)

(52) U.S. Cl.
CPC ..... *F28D 7/024* (2013.01); *F22B 37/101* (2013.01); *F22B 37/103* (2013.01); *F28D 7/026* (2013.01);
(Continued)

(58) Field of Classification Search
CPC ..... F28D 7/024; F28D 7/026; F28D 7/085; F28F 1/422; F28F 13/08; F28F 1/42; F28F 1/124
(Continued)

(56) References Cited

U.S. PATENT DOCUMENTS 166,461 A 8/1875 Houghton
2,004,252 A 6/1935 Sorensen
(Continued)

FOREIGN PATENT DOCUMENTS

EP 1734326 A1 12/2006
FR 2317961 A1 2/1977
(Continued)

OTHER PUBLICATIONS

Patent Cooperation Treaty (PCT), Notification of Transmittal of the International Search Report and the Written Opinion of the International Searching Authority, or the Declaration for PCT/US2008/069292 dated Oct. 2, 2008, 10 pages.
(Continued)

*Primary Examiner* — Len Tran
*Assistant Examiner* — Claire Rojohn, III
(74) *Attorney, Agent, or Firm* — Hoffman Warnick LLC

(57) ABSTRACT

The invention provides high-efficiency heat transfer devices and apparatuses. In one embodiment, the invention includes a vessel capable of containing the heat transfer medium, a conduit extending through a wall of the vessel, the conduit having a first surface for contacting the heat transfer medium and a second surface for contacting a fluid within the conduit, a helical member residing around and along a length of the first surface of the conduit capable of angularly directing a flow of the heat transfer medium along the first surface of the conduit; and a plurality of fins helically arranged adjacent the helical member, each fin extending through a wall of the conduit and being capable of directing at least a portion of the heat transfer medium to an area within a radius of the conduit.

13 Claims, 17 Drawing Sheets

(51) Int. Cl.

| | |
|---|---|
| ***F28F 1/20*** | (2006.01) |
| ***F28F 1/14*** | (2006.01) |
| ***F22B 37/10*** | (2006.01) |
| ***F28D 7/08*** | (2006.01) |
| ***F28F 1/12*** | (2006.01) |
| ***F28F 1/36*** | (2006.01) |
| ***F28F 13/08*** | (2006.01) |

(52) U.S. Cl.
CPC ..... *F28D 7/08* (2013.01); *F28D 7/085* (2013.01); *F28F 1/124* (2013.01); *F28F 1/36* (2013.01); *F28F 1/42* (2013.01); *F28F 1/422* (2013.01); *F28F 13/08* (2013.01); *F28F 2215/06* (2013.01)

(58) Field of Classification Search
USPC ..... 165/163, 179, 181, 182, 183, 184
See application file for complete search history.

(56) References Cited

U.S. PATENT DOCUMENTS

| | | | | |
|---|---|---|---|---|
| 2,872,164 | A | 2/1959 | Wilson | |
| 2,878,789 | A | 3/1959 | Huet | |
| 2,893,705 | A | 7/1959 | Fennell | |
| 3,474,636 | A | 10/1969 | Bligh | |
| 3,785,350 | A | 1/1974 | McCormick | |
| 3,788,281 | A | 1/1974 | Van Lookeren Campagne | |
| 3,835,816 | A | 9/1974 | Ferrin | |
| 3,916,991 | A * | 11/1975 | Trump | F24D 12/02 122/20 B |
| 3,987,761 | A | 10/1976 | Downs et al. | |
| 4,055,152 | A * | 10/1977 | Vidalenq | F23D 14/02 122/235.11 |
| 4,116,270 | A | 9/1978 | Marushkin | |
| 4,182,413 | A * | 1/1980 | Kissinger | 165/163 |
| 4,623,309 | A | 11/1986 | Teigen | |
| 6,167,846 | B1 | 1/2001 | Ogino et al. | |
| 7,063,134 | B2 * | 6/2006 | Poole | F01N 5/02 165/135 |
| 7,413,004 | B2 | 8/2008 | Okonski et al. | |
| 7,442,121 | B2 * | 10/2008 | Cassidy | F24F 13/0218 138/113 |
| 8,708,035 | B2 * | 4/2014 | Bruckmann | F22B 21/00 122/7 R |
| 2001/0018962 | A1 | 9/2001 | Joshi et al. | |
| 2003/0066624 | A1 * | 4/2003 | Holl | 165/47 |
| 2003/0085071 | A1 * | 5/2003 | Boast | F01N 1/003 181/249 |
| 2006/0102331 | A1 * | 5/2006 | Taras et al. | 165/174 |
| 2007/0012429 | A1 | 1/2007 | Siu | |
| 2007/0199688 | A1 * | 8/2007 | Okonski | F22B 9/12 165/163 |

FOREIGN PATENT DOCUMENTS

| | | | |
|---|---|---|---|
| WO | 2005021122 | A2 | 3/2005 |
| WO | 2007004176 | A1 | 1/2007 |

OTHER PUBLICATIONS

European Patent Office, Supplementary European Search Report for EP Application No. 08781417 dated Jan. 30, 2014, 7 pages.
Patent Cooperation Treaty (PCT), Notification Concerning Transmittal of International Preliminary Report on Patentability (Chapter 1 of the Patent Cooperation Treaty) for PCT/US2008/069292 dated Jan. 11, 2011, 6 pages.
European Patent Office, Office Action for Application No. 04782311.1 dated Jun. 24, 2008, 8 pages.
Canadian Patent Office, Office Action for Application No. 2,535,855 dated Sep. 13, 2010, 5 pages.
European Patent Office, Intent to Grant Patent for Application No. 04782311.1 dated May 12, 2011, 38 pages.
Canadian Application No. 2,535,855, Notice of Allowance, Dated Jul. 25, 2011, 1 page.

* cited by examiner

HIGH-EFFICIENCY ENHANCED BOILER

CROSS-REFERENCE TO RELATED APPLICATIONS

This application is a continuation-in-part of co-pending U.S. patent application Ser. No. 11/276,368, filed 27 Feb. 2006, which is hereby incorporated herein.

BACKGROUND OF THE INVENTION (1) Technical Field

The present invention relates generally to a heat exchanger, and more specifically to a "direct-fired" or "indirect-fired" boiler for generating steam, hot water, hot oil, and hot molten metals.

(2) Related Art

All boilers operate according to the physical sciences of thermodynamics and heat transfer. Essentially, forced hot gas is cooled within the boiler by transferring heat to a heat transfer medium, often water, to generate steam or hot water. Depending upon system requirements, direct-fired boilers and/or indirect-fired boilers are commonly placed in service to produce steam and hot water. In the case of a direct-fired boiler, a fueled burner or combustor is fired into the boiler, generating heat within the boiler itself. The fueled burner establishes a flame, producing a hot fluid, which is in heat transfer relation with a cooler heat transfer medium. A temperature differential between the hot fluid and the heat transfer medium drives the heat transfer process by way of conduction, convection, and radiation.

In a similar manner, a "waste heat recovery" or indirect-fired boiler makes use of residual heat from an isolated thermodynamic process. However, radiation heat transfer is a less significant heat transfer mechanism for the indirect-fired boiler. For boilers of either direct-fired or indirect-fired construction, the heat transfer medium is usually water and/or steam, due in large part to their widespread availability and substantial heat capacity. Another advantage of water/steam heat transfer media is that it presents no imminent environmental threat.

A conventional type of direct-fired boiler, commonly called a "firetube" boiler, employs a fueled burner to generate heat. The burner is fired into a single main tube, called the firetube. This firetube absorbs the majority of the radiation emitted from the combustion process. In addition, convective/conductive couples drive heat transfer between the hot fluid and the heat transfer medium throughout the device. Conventional firetube boilers typically contain one to three additional banks of significantly smaller tubes, called passes. For example, a firetube boiler design that includes two banks of tubes in addition to the firetube is termed a "three-pass firetube boiler," elicited from the path of the hot fluid. The course of flow for the "three-pass firetube boiler" occurs after the fueled burner generates hot gas inside the firetube, which is then driven through a first bank of smaller tubes flowing opposite the firetube, and then diverted through a second bank of smaller tubes flowing parallel to the firetube. A channel, called the "turn-around pass," is located between each pass, wherein the hot gas reverses direction. The hot gas cools while flowing through the tube passes of the firetube boiler by transferring energy to the heat transfer medium. For either design, all tube banks, less the "turn-around pass," are in heat transfer relationship with the heat transfer medium. In a similar manner, although a "waste heat recovery" or indirect-fired boiler does not require a firetube, the hot gas does flow sequentially from tube bank to tube bank as required to enact the heat transfer. As a result, heat transfer to the heat transfer medium is largely dependent upon the total length of the tubes it contacts. This can result in larger and more expensive devices.

Accordingly, a need exists for a heat exchange device capable of greater efficiency in the transfer of heat from its fluid to its heat transfer medium.

SUMMARY OF THE INVENTION

In devices known in the art, "conventional firetube" and "waste heat recovery" boilers each require many small tubes making successive passes within the boiler. In one embodiment of the invention, however, an enhanced conduit replaces numerous conventional small tubes. In some embodiments, the enhanced conduit incorporates a plurality of fins, each of which extends through a wall of the conduit. In other embodiments, the enhanced conduit incorporates a plurality of tubes along its inner surface, through which a heat transfer medium flows. Both designs enhance the heat transfer relationship between the hot fluid and the heat transfer medium by providing a continuous heat transfer relationship with the heat transfer medium, increasing the surface area involved in the heat transfer relationship and enhancing convection/conduction couples. For some applications, all of the tube banks of other devices in the art can be replaced by one continuous enhanced conduit.

The High-Efficiency Enhanced Boiler (HEEB) of the present invention offers improvements over conventional designs. A first improvement is a continuous heat transfer relation by surrounding the enhanced conduit with heat transfer medium. A second improvement is the possibility of substantial turndown ratios. A third improvement is the feasibility of manufacturing devices for applications requiring steam pressures in excess of 21.4 atmospheres absolute, whereas conventional firetube boilers have practical limitations. Finally, the HEEB is readily configurable to generate superheated steam.

Therefore, a first objective of the present invention is to provide a High Efficiency Enhanced Boiler capable of generating superheated steam or steam/hot water output. A second objective of the present invention is to provide an effective method for direct-fire or indirect-fire heat transfer to a molten metal heat transfer medium. A third objective of the present invention is to provide a High Efficiency Enhanced Boiler for "waste heat recovery" or indirect-fired boiler applications. A fourth objective of the present invention is to provide a boiler with an enhanced conduit capable of removing heat from the burner flame by proximally located fins.

A first aspect of the invention provides a device for transferring heat from a fluid to a heat transfer medium comprising: a vessel capable of containing the heat transfer medium; a conduit extending through a wall of the vessel, the conduit having a first surface for contacting the heat transfer medium and a second surface for contacting a fluid within the conduit; a helical member residing around and along a length of the first surface of the conduit capable of angularly directing a flow of the heat transfer medium along the first surface of the conduit; and a plurality of fins helically arranged adjacent the helical member, each fin extending through a wall of the conduit and being capable of directing at least a portion of the heat transfer medium to an area within a radius of the conduit, thereby being capable of contacting both the heat transfer medium and the fluid, the helical arrangement of the plurality of fins being capable of imparting an angular flow to the fluid, wherein heat is transferred from the fluid to the heat transfer medium via the plurality of fins.

A second aspect of the invention provides a device for transferring heat from a fluid to a heat transfer medium comprising: a vessel capable of containing the heat transfer medium; a conduit extending through a wall of the vessel, the conduit having a first surface for contacting the heat transfer medium and a second surface for contacting a fluid within the conduit; a plurality of fins helically arranged around and along a length of the first surface of the conduit, each fin extending through a wall of the conduit and being capable of directing at least a portion of the heat transfer medium to an area within a radius of the conduit, thereby being capable of contacting both the heat transfer medium and the fluid, the helical arrangement of the plurality of fins being capable of imparting an angular flow to the fluid, wherein heat is transferred from the fluid to the heat transfer medium via the plurality of fins.

A third aspect of the invention provides a heat transfer apparatus comprising: a body; a tail adjacent the body; and a void within the body capable of holding a heat transfer medium, wherein the apparatus is capable of transferring heat from a fluid contacting the tail to the heat transfer medium.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein:

FIG. 24 shows a front cross-sectional view of the apparatus of FIG. 22.

DETAILED DESCRIPTION OF THE INVENTION

Figure 3:
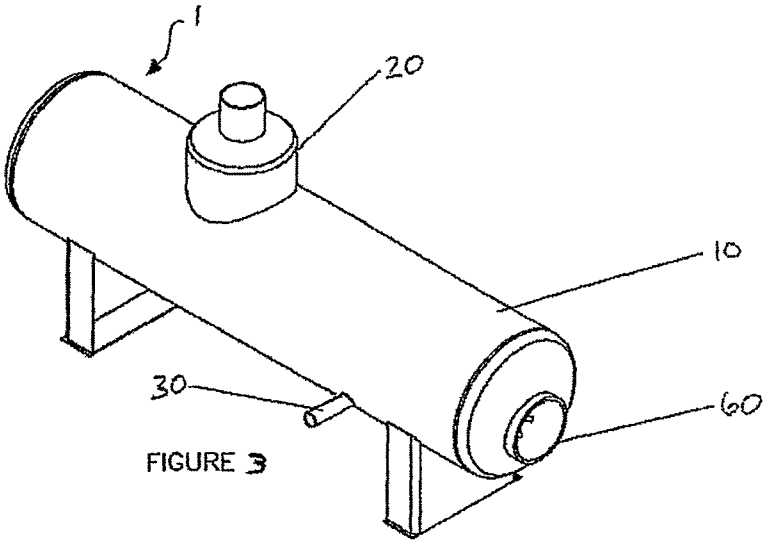
FIG. 3 shows a side elevational view of one embodiment of the invention.
Figure 2:
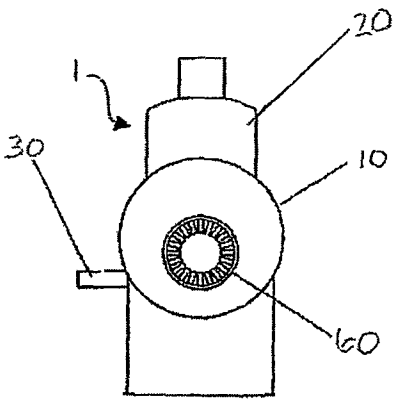
FIG. 2 shows a front-view of one embodiment of the invention.
Figure 1:
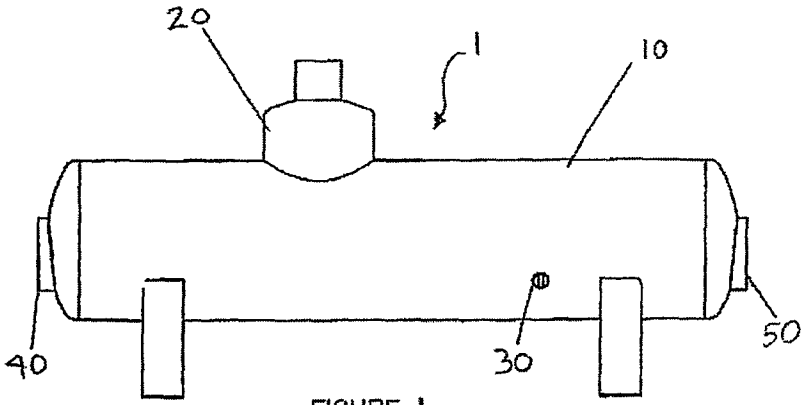
FIG. 1 shows a side-view of one embodiment of the invention.

FIGS. 1 through 6 depict a boiler 1 of the present invention, which includes a vessel 10 for containing a heat transfer medium. In some embodiments, vessel 10 is pressurized internally and designed according to American Society of Mechanical Engineers (ASME) codes for boilers and pressure vessels. The ASME codes are one of a few fabrication standards honored worldwide. Typically, internal design pressures for this class of vessel range from 1.1 to 21.4 atmospheres absolute, although there are vessels in existence that exceed pressures of 21.4 atmospheres absolute. For reasons of safety and reliability, the ASME codes and others restrict the materials and fabrication methods for vessels with internal design pressures over 2.0 atmospheres absolute. Therefore, only code recognized materials, such as, but not limited to, SA516 GR70, SA240 304, SA312 TP304, and SA106 B, are acceptable for fabrication of vessel 10. In addition, the adherence to a Code infers that only a facility skilled in the art can fabricate a device such as vessel 10. Additionally, insulation (not shown) covers the exterior surface of vessel 10 for reasons of efficiency and safety.

Four basic penetrations are commonly made to vessel 10. In actuality, and commonly known to those of ordinary skill in the art, several penetrations of vessel 10 are required. Process and policy require penetrations for boiler inspection, boiler drainage, pressure relief, and sensing/gauging. Although the previously mentioned compulsory penetrations are not shown, it is assumed that these requirements are met in the final or code-authorized design.

The sump 20 proximal to the top of vessel 10 is indicative of a steam boiler. By design, sump 20 is known to moderate surging, a problem associated with steam production. Consequently, in order to maintain a sufficient level of a heat transfer medium (e.g., water in the case of a steam boiler), a feedwater inlet 30 is located near the bottom of vessel 10. Any steam having left sump 20 continues upstream to deliver the stored energy and then returns downstream as condensate to feedwater inlet 30, thus completing the cycle. This process is typical of a closed steam/water system. In reality, system losses require that provisions be made to replenish the heat transfer medium (e.g., make-up water). Furthermore, de-aerators and water treatments are meant to protect the system components from oxidation and chemical attack. However, since de-aerators and chemical treatments are known to those of ordinary skill in the art, further explanation will not be given.

The final two penetrations shown in the vessel 10 are the hot fluid inlet 40 and the flue outlet 50 of enhanced conduit 60. Situated entirely within vessel 10, enhanced conduit 60 forms a non-communicating pressure boundary between a hot fluid contained within it and a heat transfer medium within vessel 10. Thus, enhanced conduit 60 is entirely in heat transfer relation with the hot fluid and the heat transfer medium. Often, the hot fluid is hot air generated from a burner, although other fluids or liquids may be used. For example, it may be desirable to cool a molten metal or salt. In such a situation, the molten meal or salt may be passed through enhanced conduit 60, transferring its heat to a heat transfer medium.

Similarly, although the embodiments of the invention are often depicted as steam boilers, necessitating that the heat transfer medium be water, other fluids or liquids are also allowable. For example, the heat transfer medium may be any liquid, gas, or similar material with suitable heat transfer properties.

Figure 6:
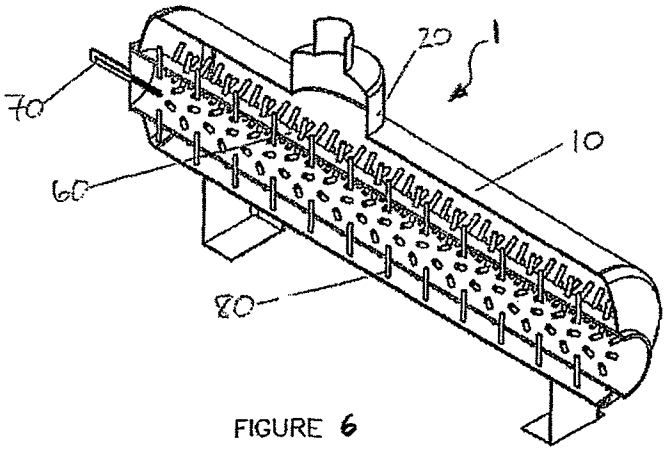
FIG. 6 shows a side elevational view of the device of FIG. 4.
Figure 5:
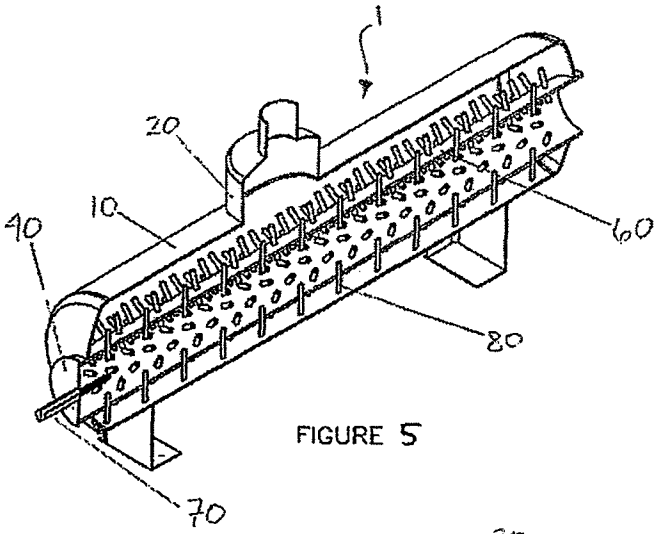
FIG. 5 shows a side elevational view of the device of FIG. 4.
Figure 4:
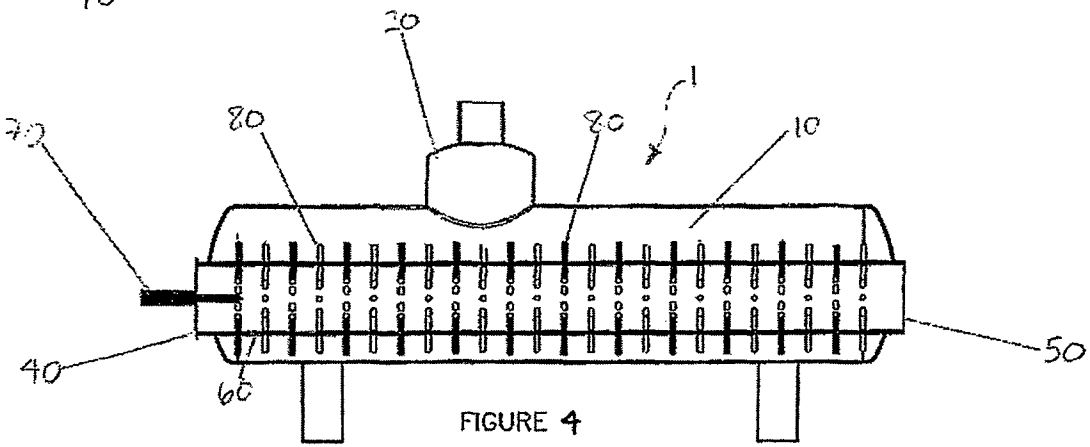
FIG. 4 shows a cross-sectional view of one embodiment of the invention.
Figure 8:
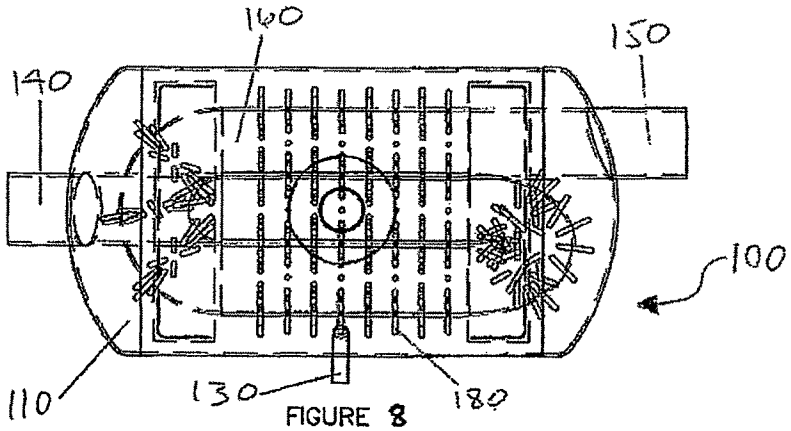
FIG. 8 shows a top-view of the device of FIG. 7.
Figure 7:
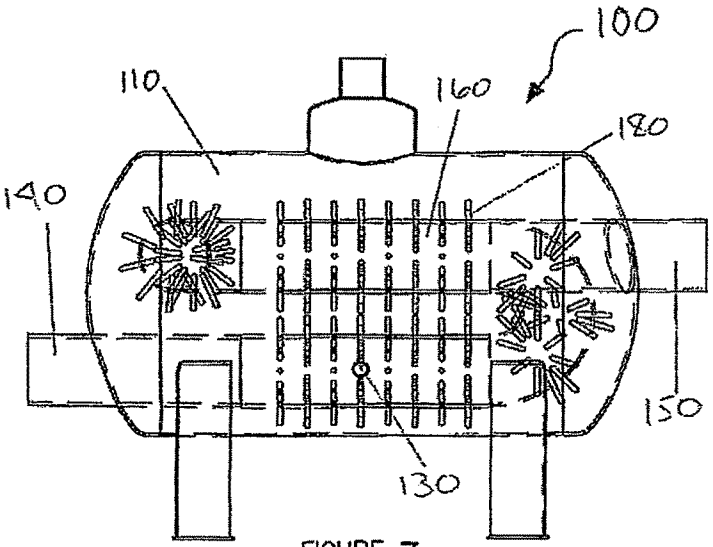
FIG. 7 shows a cross-sectional view of one embodiment of the invention.
Figure 9:
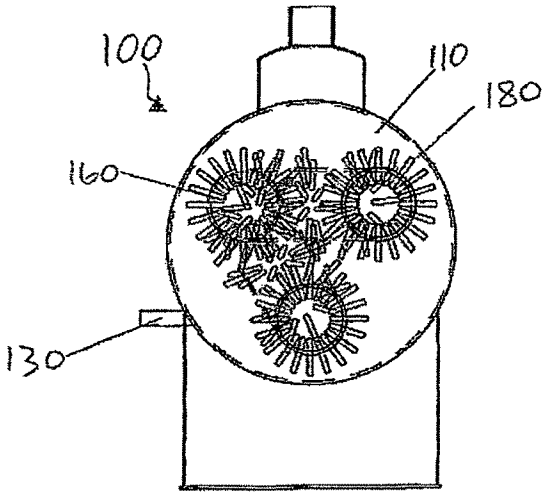
FIG. 9 shows a front-view of the device of FIG. 7.
Figure 12:
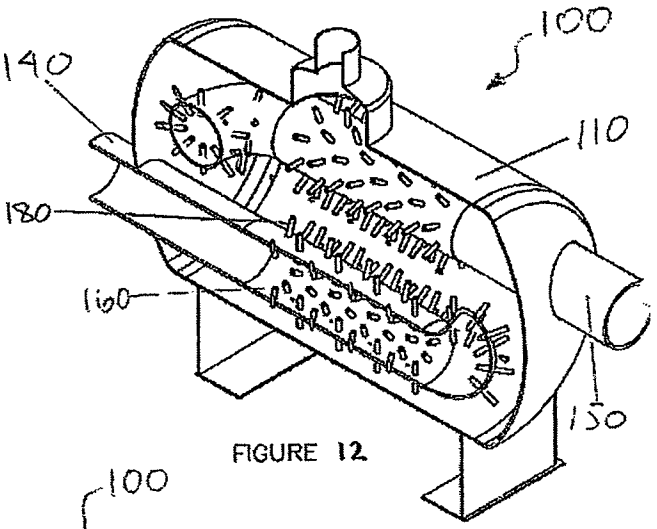
FIG. 12 shows a side elevational view of the device of FIG. 10.
Figure 11:
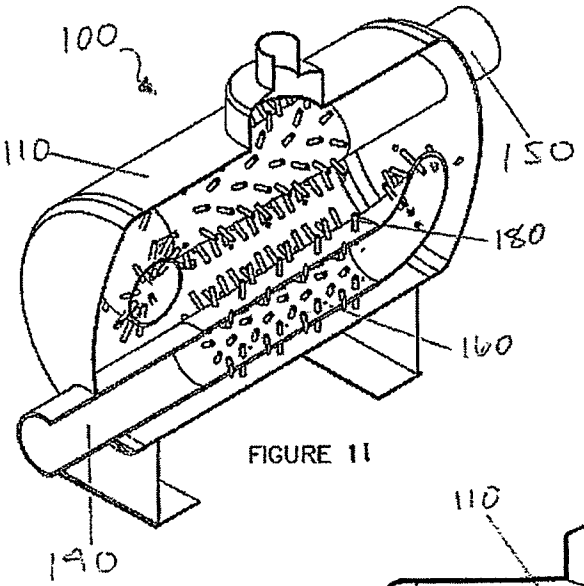
FIG. 11 shows a side elevational view of the device of FIG. 10.
Figure 10:
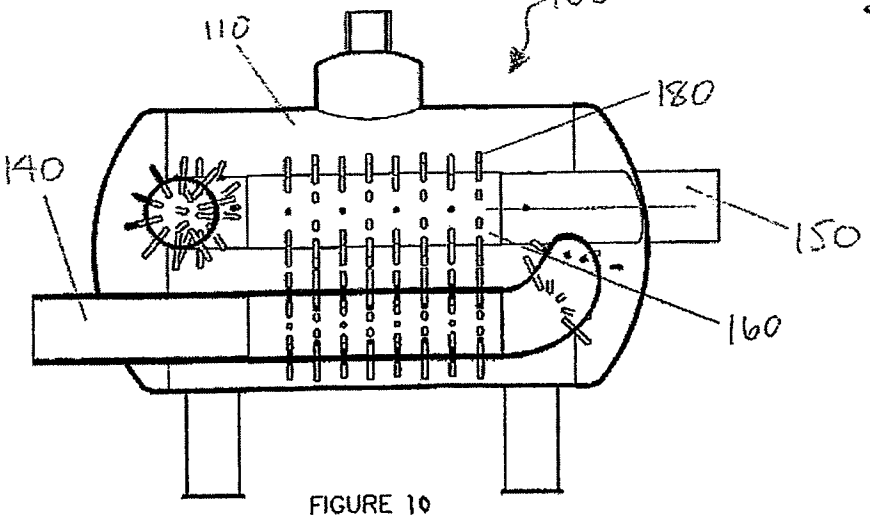
FIG. 10 shows a cross-sectional view of one embodiment of the invention.
Figure 14:
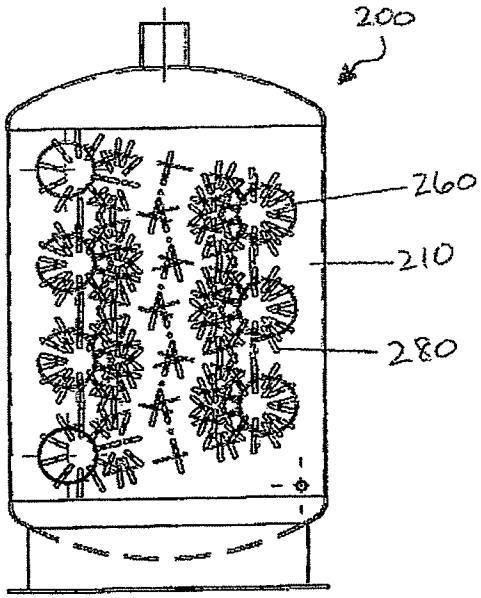
FIG. 14 shows a cross-sectional view of one embodiment of the invention.
Figure 15:
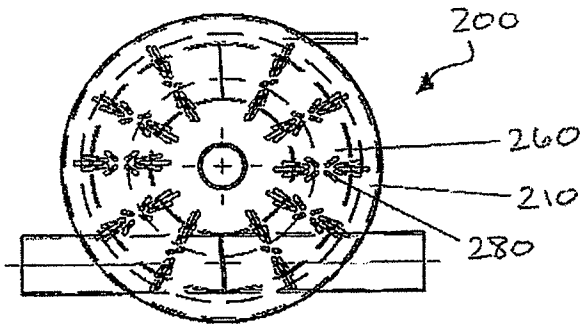
FIG. 15 shows a top view of the device of FIGS. 13 and 14.
Figure 13:
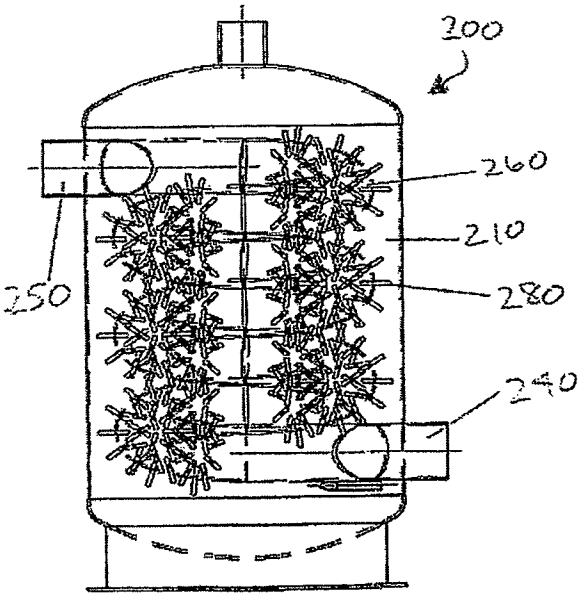
FIG. 13 shows a cross-sectional view of one embodiment of the invention.
Figure 18:
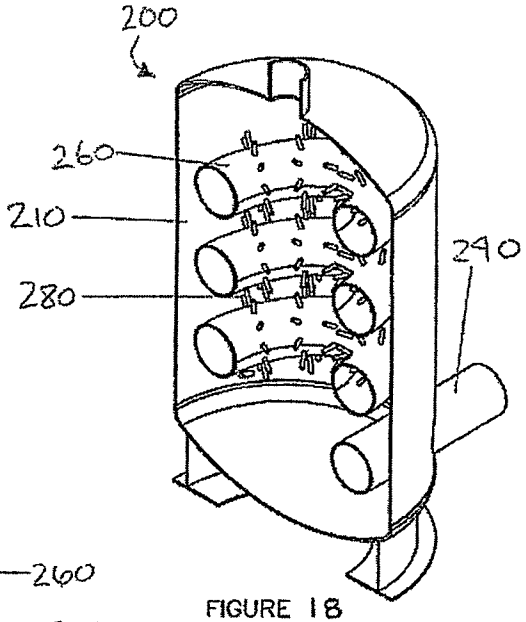
FIG. 18 shows a side elevational view of the device of FIG. 16.
Figure 16:
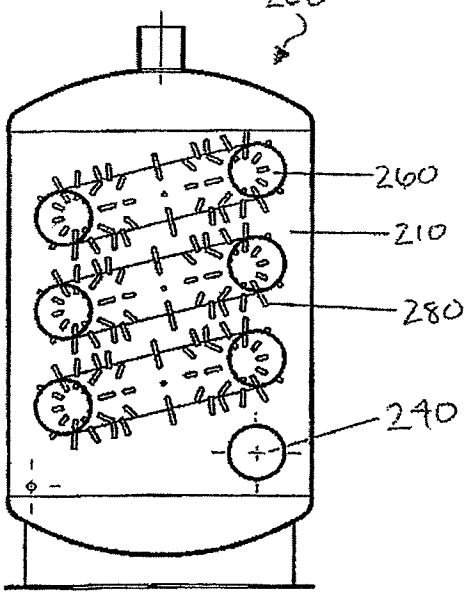
FIG. 16 shows a cross-sectional view of one embodiment of the invention.
Figure 17:
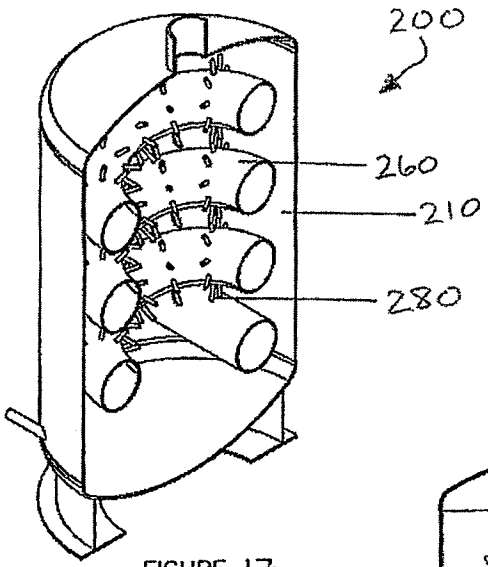
FIG. 17 shows a side elevational view of the device of FIG. 16.

In a "single pass firetube boiler," enhanced conduit 60 extends horizontally near a central axis of vessel 10, as shown in FIGS. 4 through 6. A fuel-fired burner 70, generates heat and energy, which are forced into enhanced conduit 60. Burner fuel may include, for example, coal, distillate oil, natural gas, methanol, ethanol, propane, and liquefied petroleum gas. A forced draft subassembly (not shown) regulates the flow of gas to burner 70 so that the proper ratio of oxygen-to-fuel can be attained, and forces or drives the hot gas into enhanced conduit 60.

Essentially, enhanced conduit 60 is under the same pressure as vessel 10, except that the pressure is exerted on an internal surface of vessel 10 and an external surface of enhanced conduit 60. Once again, the ASME code or other accepted design standard is invoked to comply with engineering requirements. In general, with respect to the length of enhanced conduit 60, external pressure is more severe than internal pressure in terms of local stress. Generally, when external pressure applied to a conduit exceeds allowable stress limits, buckling or failure occurs. Accordingly, in one embodiment of the invention, the cross-sectional geometry of enhanced conduit 60 is circular. However, other shapes, including but not limited to square, rectangular, or ellipsoidal, are possible and within the scope of the present invention.

Within enhanced conduit 60, a plurality of fins 80 extend intimately into the path of the hot fluid. Fins 80 establish a series of obstructions that force the hot fluid to assume a path around individual fins 80 in a manner that elicits turbulence, thereby enhancing heat transfer. Furthermore, a portion of each fin 80 extends through a wall of enhanced conduit 60 and contacts the heat transfer medium. Fins 80 thereby increase heat transfer through turbulent mixing of the hot fluid and by increasing the surface area exposed to the hot fluid and/or the heat transfer medium. Each fin 80 may be oriented through a wall of enhanced conduit 60 in any number of angles relative to the long and short axes of enhanced conduit 60. As such, fins 80 may be oriented to direct the flow of the hot fluid and/or the heat transfer medium along a particular path.

Each fin 80 is fabricated from materials that demonstrate structural stability while providing good heat transfer characteristics. Possible fin 80 materials include, but are not limited to, generic steels, metals (including copper, molybdenum, etc.), ceramics, refractory materials, and engineered composites. A largely material-dependent objective of the present invention is the ability to extract heat by placing fins 80 in close proximity to the flame of burner 70. One example (not shown) of a fin configuration capable of meeting this objective comprises a cylindrical generic steel body fitted with a spherical molybdenum tip.

For simplicity in depiction, cylindrical-shaped fins 80 are shown. However, other fin shapes or combinations of shapes are possible and considered to be within the scope of the present invention. Such shapes include, for example, square, elliptical, aerodynamic, rectangular, and spherical. In addition, such fins may be constructed with through holes, with threaded holes, with blind holes, and may be tapered or threaded. As an example (not shown) of a multi-geometric combination, the fin shape may be cylindrical at one end, tapered in the middle, and rectangular with blind holes toward its opposite end. Each fin 80 may be mechanically fastened to enhanced conduit 60 in an ASME code or other acceptable method, forming a pressure-rated joint.

In general, the heat transfer medium is water/steam, although molten metal (heat transfer salt) and hot oil systems are possible. As suggested earlier, widespread availability and substantial heat capacity are factors favoring water/steam as the most common heat transfer medium. At startup, vessel 10, around the outside surface of enhanced conduit 60, is filled with the heat transfer medium (e.g., water). Demand for steam signals burner 70 to ignite fuel into a combustible flame. The flame is directed at hot fluid inlet 40 of enhanced conduit 60, whereby heat is drawn off by fins 80 located near the outer flame boundary. Fins 80 extract substantial energy from the flame by radiation/conduction/convection heat transfer to the heat transfer medium over the length of the flame. At the extreme boundary of combustion, where the flame ceases to exist, fins 80 remove heat from the hot fluid stream by convection/conduction couples. Additionally, the portion of each fin 80 extending within enhanced conduit 60 causes turbulence in the hot fluid stream, accelerating convection heat transfer, while the portion of each fin 80 extending outside enhanced conduit 60 provides more surface area for convective heat transfer to occur. More particularly, a balanced energy flow exists in the region of each fin 80. The exhausted hot gas leaves enhanced conduit 60 through the flue outlet 50 on route to the stack (not shown). As the heat transfer medium (e.g., water) is heated, it evaporates and exits at sump 20. From sump 20, the steam goes to the load (not shown), where condensation occurs. The steam condenses to water and is pumped into inlet 30 in order to maintain a constant level of heat transfer medium within boiler 1.

Example 1

Referring to FIGS. 7-12, a direct-fired 3-pass 30-horsepower boiler 100 is shown, fabricated in accordance with the present design criteria for a pressure of 10 atmospheres and requiring a one million BTU (British thermal units) natural gas burner. Cylindrical vessel 110 has dimensions of 42-inches O.D. wide by 60-inches O.D. long, with ten-inch diameter enhanced conduit 160 winding through the interior of the vessel. Hot fluid enters boiler 100 through hot fluid inlet 140, passes through enhanced conduit 160, and exits through flue outlet 150. Condensate returns to boiler 100 through feedwater inlet 130. There are 280 ¾" diameter fins 180 located circumferentially throughout enhanced conduit 160 in sets of ten. Fins 180 are mechanically fastened to enhanced conduit 160 by virtue of a self-locking taper and seal welding. The temperature of the exhausted flue gas is approximately 230 C. The thermal efficiency of such a design is increased, in part, due to the fact that "turn-around passes" are maintained in heat transfer relationship with the heat transfer medium within the boiler.

Example 2

Referring now to FIGS. 13-18, a direct-fired boiler 200 is shown with a coiled enhanced conduit 260. The long axis of cylindrical vessel 210 is oriented vertically, rather than horizontally as in Example 1. Rather than completing a series of reversals in direction as in Example 1, enhanced conduit 260 is coiled within vessel 210, completing a total of three revolutions. Hot fluid enters boiler 200 through hot fluid inlet 240, passes through enhanced conduit 260, and exits through flue outlet 250. As in Example 1, enhanced conduit 260 contains a plurality of fins 280 located around its circumference and along its length. Fins 280 may be fastened to enhanced conduit 260 by any of a number of means described above.

Example 3

Figure 19:
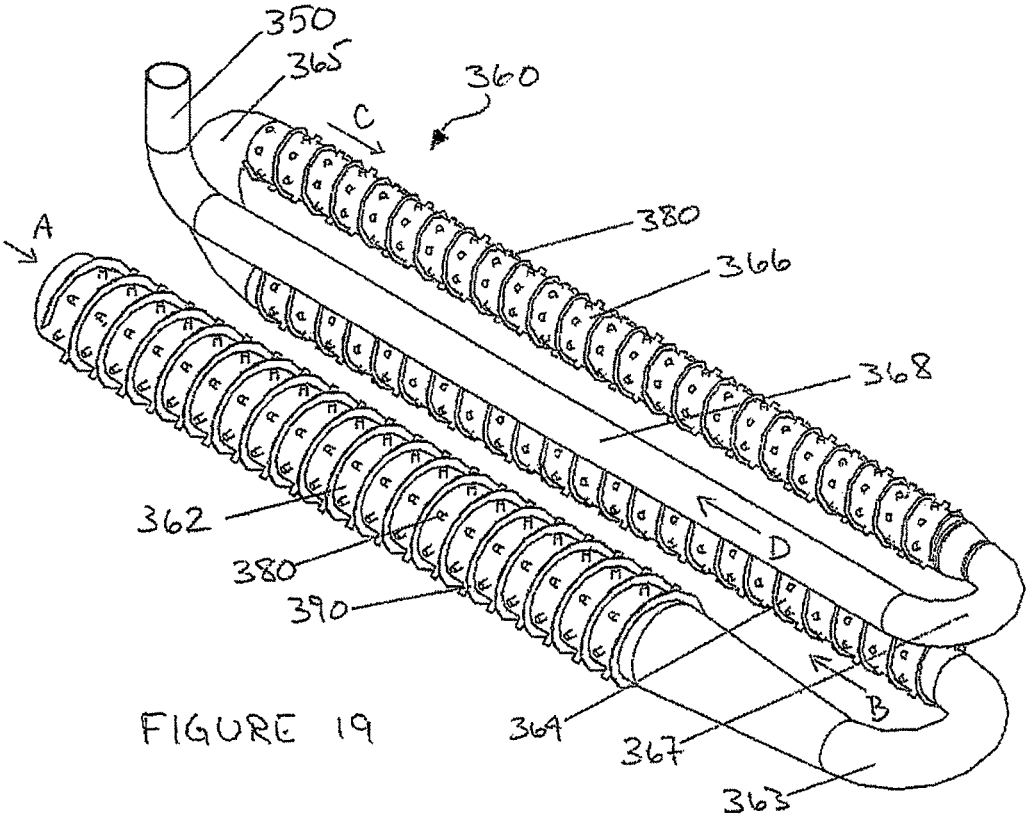
FIG. 19 shows a side elevational view of an enhanced conduit apparatus according to the invention.
Figure 20:
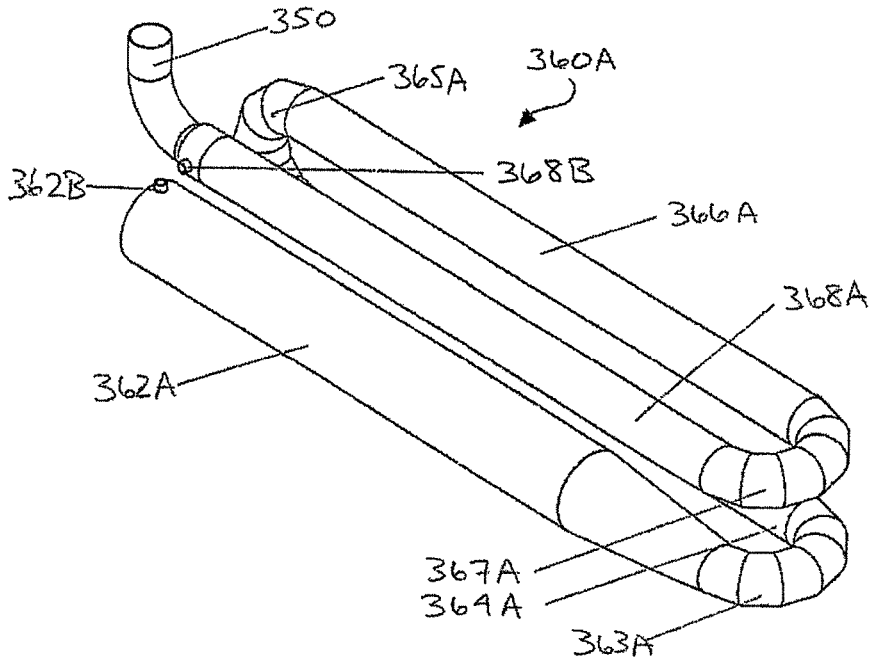
FIG. 20 shows a housing enclosing the apparatus of FIG. 19.
Figure 21:
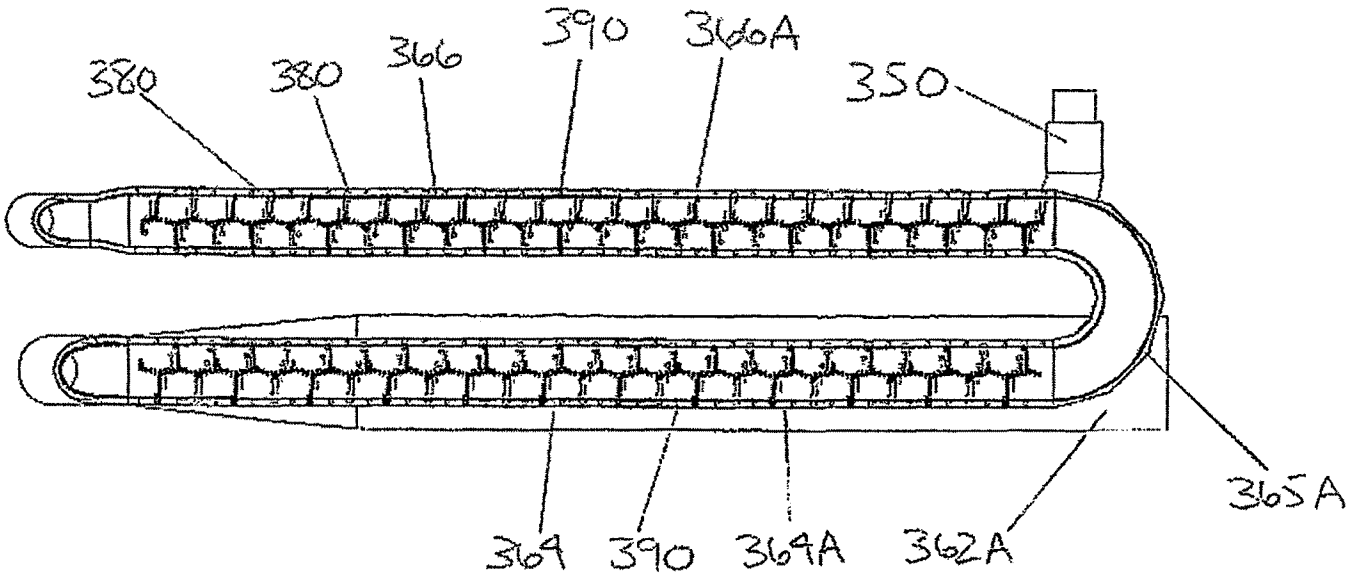
FIG. 21 shows a cross-sectional view of the apparatus of FIG. 19.

Referring to FIGS. 19-21, a 4-pass conduit 360 is shown. Unlike earlier-described embodiments, wherein a heat transfer medium sits within a vessel, the depicted embodiment incorporates a housing 360A around the apparatus 360. Housing 360A directs a heat transfer medium along an outer surface of a pass 362, 364, 366, 368 as the hot fluid is directed along an inner surface of the same pass. In some embodiments, such as that shown in FIG. 20, the apparatus has a "reverse flow," wherein as the hot fluid enters first pass 362 (often a firetube), the heat transfer medium enters through a heat transfer medium inlet 368B at a distal end of the fourth pass housing 368A, flows in a direction substantially opposite that of the hot fluid, and exits through a heat transfer medium outlet 362B at a proximal end of the first pass housing 362A.

In the embodiment depicted in FIG. 19, three of the four passes 362, 364, 366 are enhanced, each containing a plurality of fins 380 extending through a wall of the pass. Optionally, one or more enhanced pass 362, 364, 366 may contain a helical member 390 along its outer surface. Located in such a manner, helical member 390 contacts or resides close to an inner surface of each enhanced pass housing 362A, 364A, 366A of apparatus housing 360A and directs the heat transfer medium along the surface of the pass 362, 364, 366, effectively increasing contact between the pass and the heat transfer medium. Accordingly, in order to increase contact between fins 380 and the heat transfer medium, helical member 390 preferably lies parallel to the pattern of fins 380. Such an arrangement effectively creates channels between the surface of a pass 362, 364, 366 and a pass housing 362A, 364A, 366A, in which are situated a plurality of fins 380.

Each pass 362, 364, 366, 368 is connected to another by a turn-around pass 363, 365, 367 which substantially reverses the direction of flow of the fluid within enhanced conduit 360. For example, the fluid within enhanced conduit 360 initially flows through first pass 362 in direction A. Upon passage through first turn-around pass 363, the fluid substantially reverses direction, entering second pass 364 in direction B. Similarly, upon passage through second turn-around pass 365, the fluid again substantially reverses direction, entering third pass 366 in direction C. Finally, the fluid passes through third turn-around pass 367 and enters a non-enhanced pass 368 in direction D before flowing through flue outlet 350.

FIG. 21 shows a side cross-sectional view of the apparatus in order to depict the obstructions within each enhanced pass 364, 366 created by the interior projections of fins 380. Also depicted are the channels created between helical member 390 and enhanced pass housings 364A, 366A.

As depicted, only passes 362, 364, 366 contain fins 380 and, optionally, helical member 390. However, it should be recognized that turn-around passes 363, 365, 367 may be enhanced with fins 380 and/or helical member 390 in addition to or instead of passes 362, 364, 366.

Example 4

Figure 22:
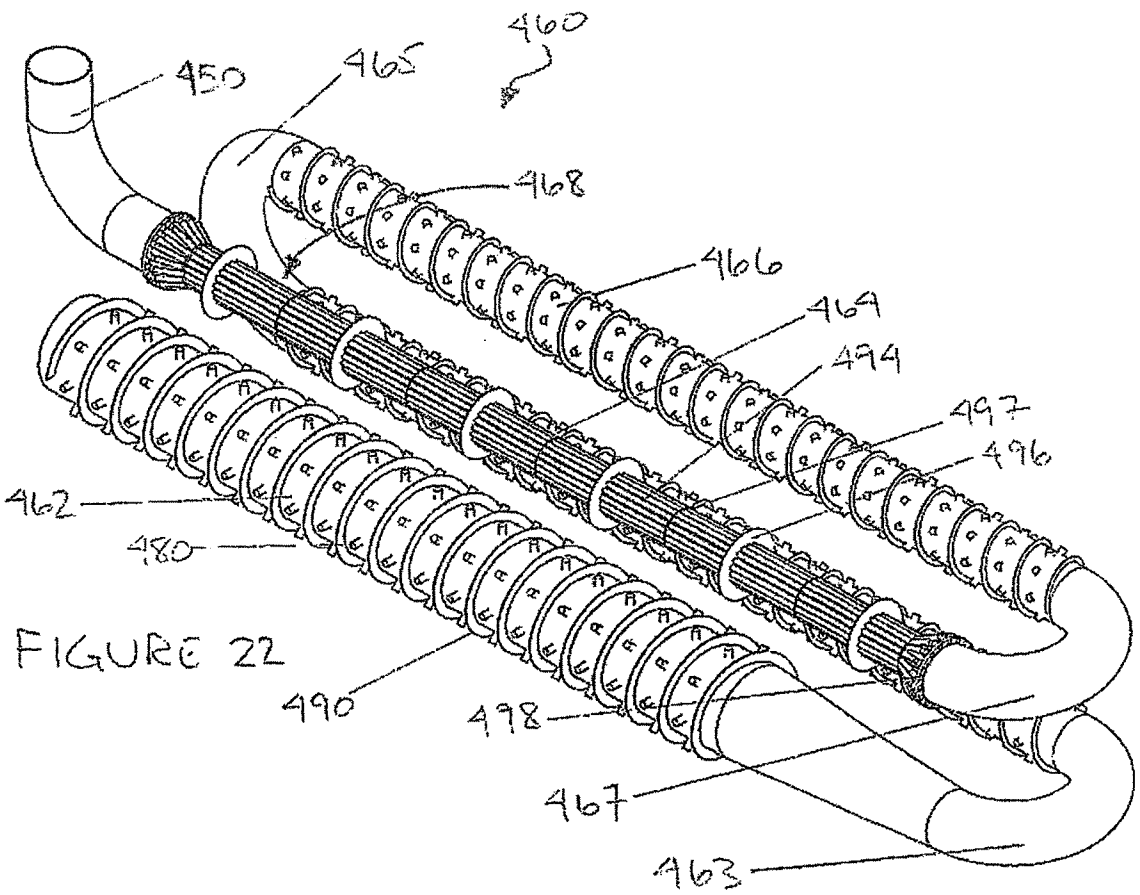
FIG. 22 shows a side elevational view of an alternative embodiment of an enhanced conduit apparatus according to the invention.
Figure 23:
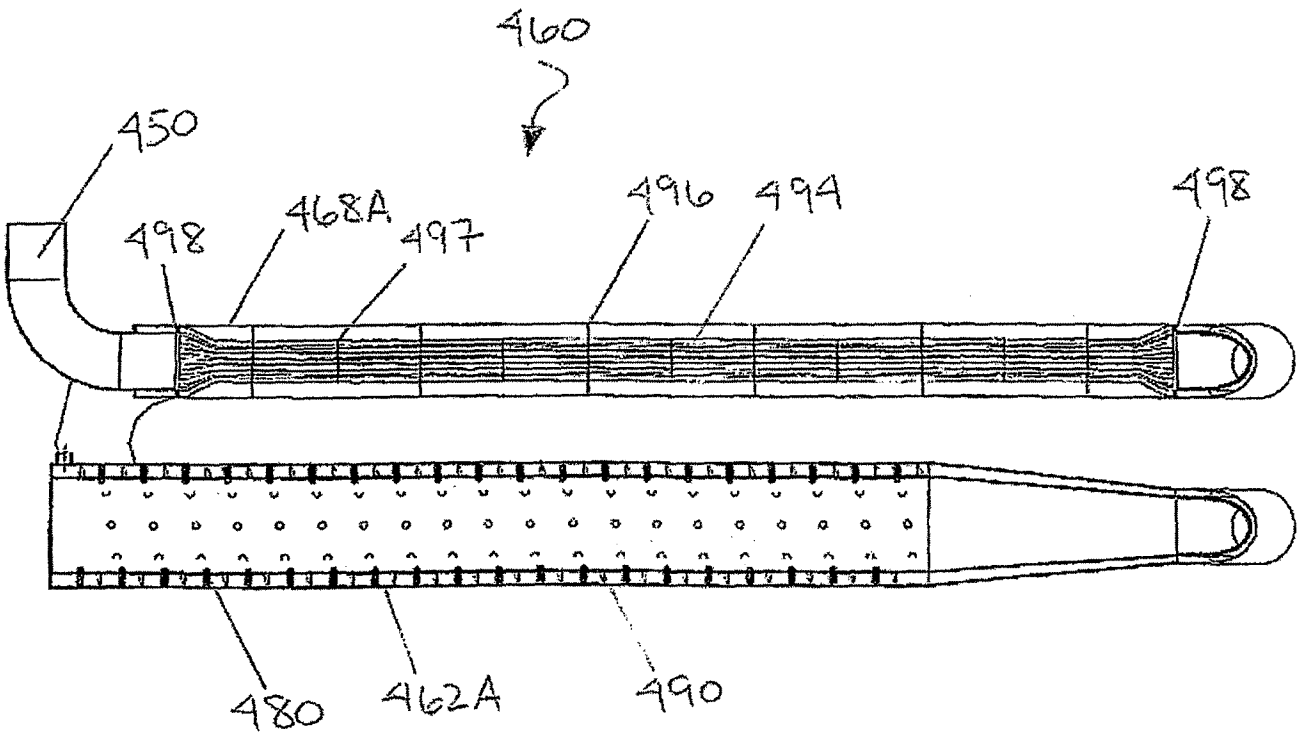
FIG. 23 shows a side cross-sectional view of the apparatus of FIG. 22.

Referring to FIGS. 22-24, a modified 4-pass enhanced conduit 460 is shown. Unlike the device in FIG. 19, wherein fourth pass 368 is an unenhanced conduit, modified enhanced conduit 460 includes a fourth pass 468 comprised of a plurality of tubes 494. The plurality of tubes 494 is preferably arranged in a circular pattern, as depicted most clearly in FIG. 24, although other shapes are allowable. Similarly, while a plurality of tubes 494 is depicted, a single tube is also within the scope of the invention.

Heat transfer medium enters an opening 498 in an end of each tube 494 and flows through tube 494, increasing the heat transfer from the hot fluid within fourth pass 468 to the heat transfer medium. Due to the transfer of heat from the hot fluid to the heat transfer medium, the difference in temperature between the hot fluid and the heat transfer medium is generally smaller along fourth pass 468 than along earlier passes 462, 464, 466. Where such a smaller temperature difference exists, it has been found that such a plurality of tubes more efficiently transfers heat from the hot fluid to the heat transfer medium than does a plurality of fins 480 or a plurality of fins 40 and helical members 490, such as those along earlier passes 462, 464, 466.

Optionally, one or more baffles 496, 497 may be placed along the length of the plurality of tubes 494. Such baffles may be outer baffles 496, located around tubes 494, or inner baffles 497, located within the plurality of tubes 494. Outer baffles 496 are preferably ring shaped so as to fit around a circular arrangement of the plurality of tubes 494, although other shapes are allowable. Outer baffles 496 preferably contact or reside close to an inner surface of fourth pass housing 468A. Inner baffles are preferably disc shaped so as to fit within a circular arrangement of the plurality of tubes 494, although other shapes are allowable. Outer baffles 496 and inner baffles 497 disrupt the flow of the hot fluid within pass 468. Inner baffles 497 force the hot fluid outside the plurality of tubes 494 to a location between the plurality of tubes 494 and fourth pass housing 468A, while outer baffles 496 force the hot fluid in the opposite direction, i.e., into the center of the plurality of tubes 494. This disruption of the flow of the hot fluid increases heat transfer from the hot fluid to the heat transfer medium.

Example 5

Figure 25:
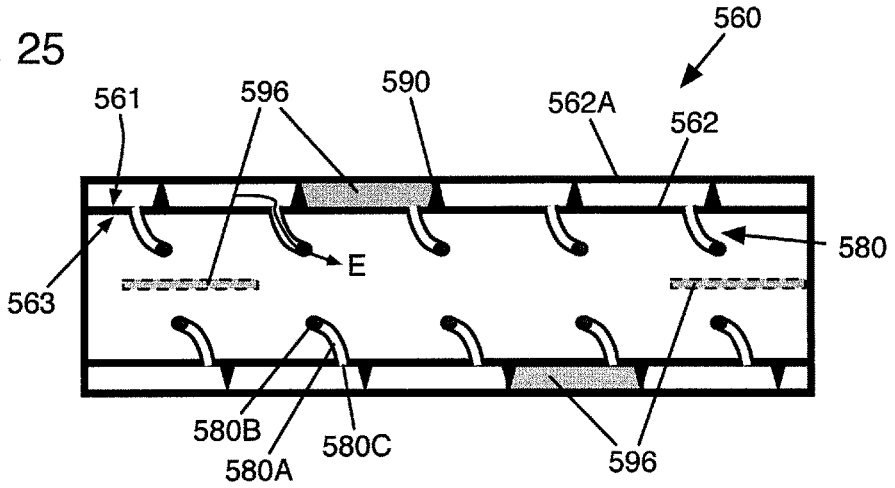
FIG. 25 shows a side cross-sectional view of an alternative embodiment of the invention.
Figure 26:
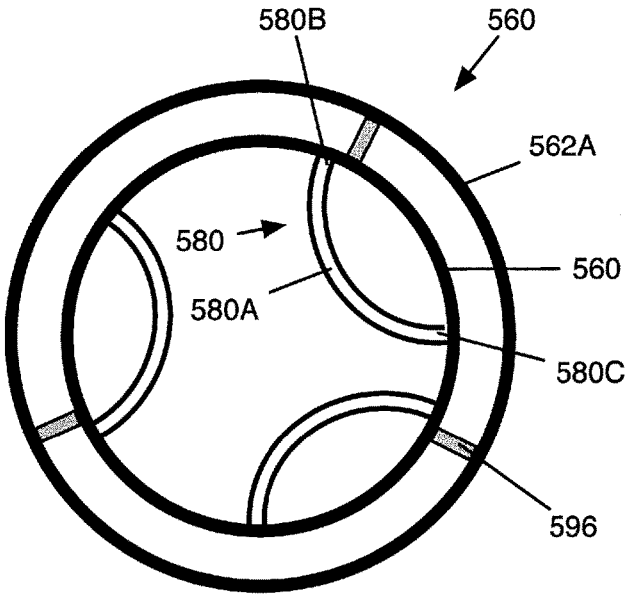
FIG. 26 shows a front cross-sectional view of the device of FIG. 25.

FIGS. 25 and 26 show a cross-section portion of a conduit 560 according to alternative embodiment of the invention, the conduit including a first surface 561 for contacting a heat transfer medium and a second surface 563 for contacting a fluid within conduit 560. As in the embodiments above, a helical member 590 resides between a pass 562 and pass housing 562A. Here, a plurality of elongate hollow fins 580 each makes two penetrations of the pass 562, with the body 580A of each fin 580 residing within the pass 562 and proximal and distal ends of the hollow fins residing at the two penetrations. Such an arrangement passes at least a portion of the heat transfer medium along path E (within fins 580), and within the hot fluid-filled pass 562, thereby increasing heat transfer from the hot fluid to the heat transfer medium.

In FIG. 26, a plurality of baffles 596 are spaced between the pass 562 and the pass housing 562A. Such an arrangement aids in directing flow of the heat transfer medium into the fins 580.

Example 6

Figure 27:
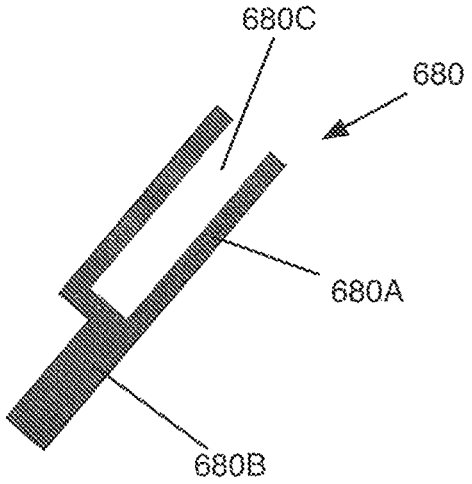
FIG. 27 shows a side cross-sectional view of a heat transfer apparatus according to one embodiment of the invention.
Figure 28:
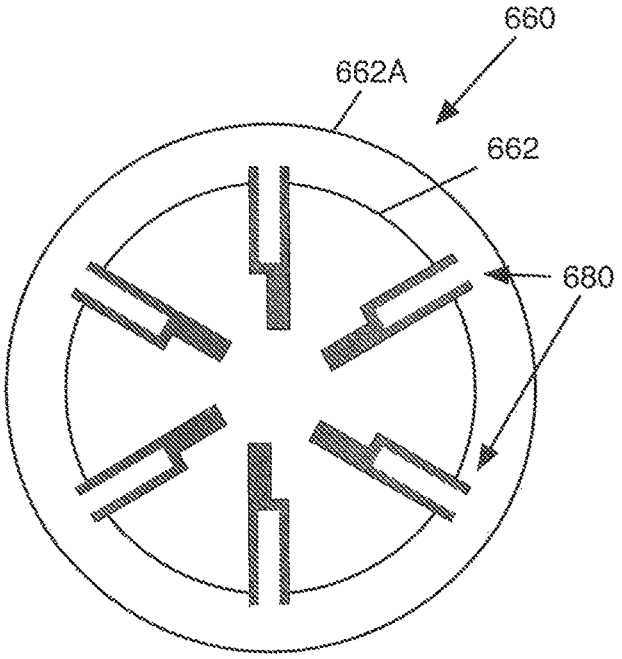
FIG. 28 shows a front cross-sectional view of a conduit containing a plurality of apparatuses of FIG. 27.
Figure 29:
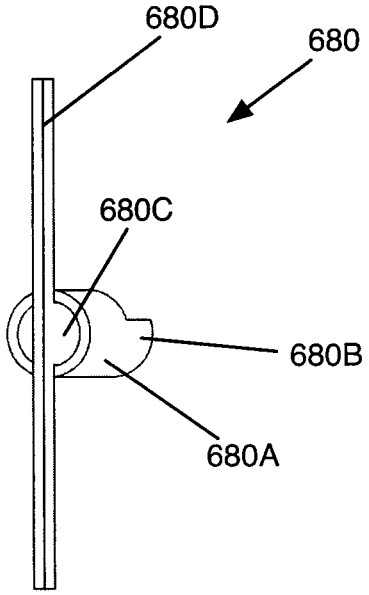

FIGS. 27-30 show alternative embodiments of a fin according to the invention. In FIGS. 27 and 28, the fin 680 includes a body 680A, tail 680B, and void 680C. When penetrating a pass 662, as in FIG. 28, a heat transfer medium flowing between the pass 662 and the pass housing 662A is directed into the void 680C of the pin 680, thereby increasing heat transfer from a hot fluid within the pass 662 to the heat transfer medium.

Figure 29:
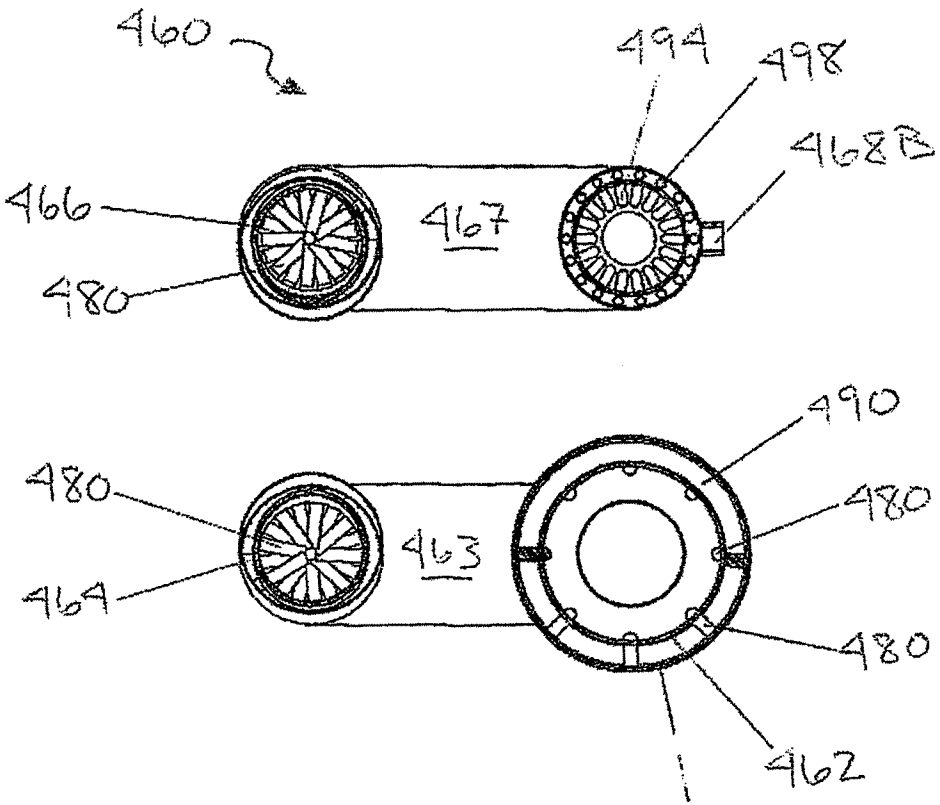
FIGS. 29-30 show alternative embodiments of the apparatus and conduit of FIGS. 27 and 28, respectively.
Figure 30:
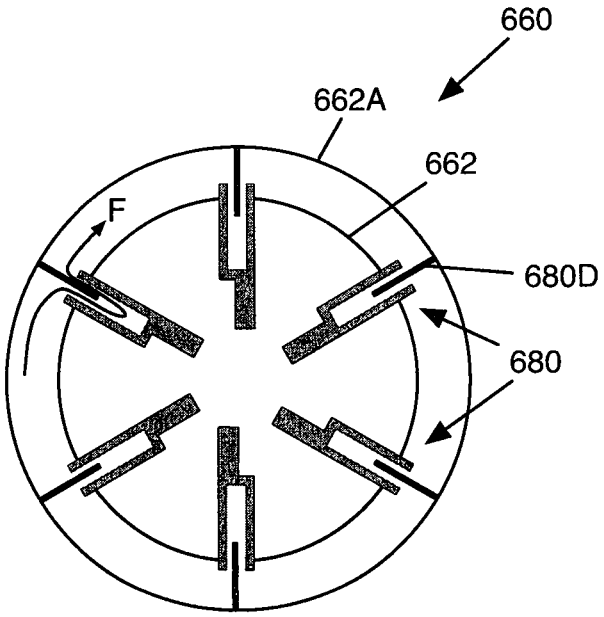

In FIGS. 29 and 30, the fin 680 further includes a baffle 680D. As a heat transfer medium between the pass 662 and pass housing 662A travels along path F (helically around pass 662, as directed, for example by a helical member, not shown), at least a portion of the heat transfer medium is directed into the void 680C of the pin 680, thereby increasing heat transfer from a hot fluid within the pass 662 to the heat transfer medium.

Example 7

Figure 31:
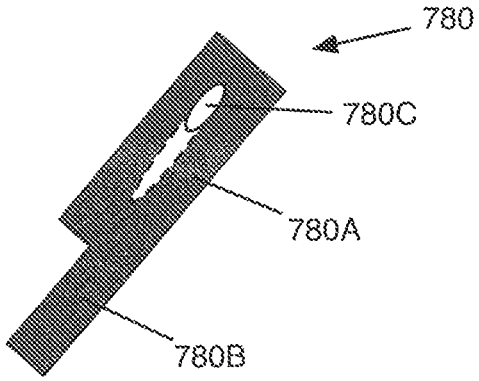
FIGS. 31-33 show alternative embodiments of the apparatus of FIG. 27.
Figure 32:
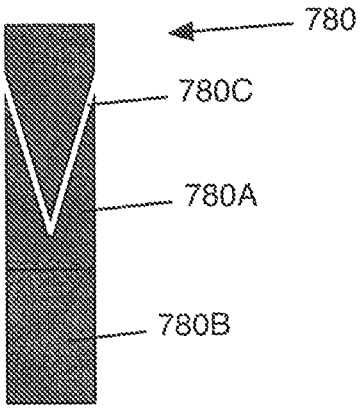
Figure 33:
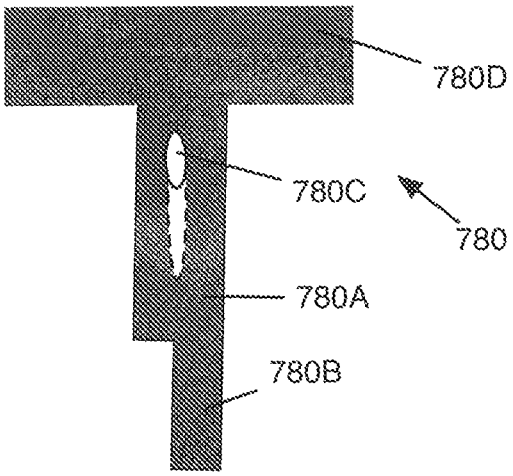

FIGS. 31-33 show additional alternative embodiment of a fin according to the invention. As in the embodiments in FIGS. 27-30, the fin 780 includes a body 780A and tail 780B. However, rather than a void, fin 780 includes a channel 780C within the body 780A, such that a heat transfer medium may pass through the channel 780C, effectively increasing the surface area of the body 780A to which the heat transfer medium is exposed and, consequently, increasing the heat transfer from a hot fluid. In FIG. 33, fin 780 further includes a baffle 780D to aid in directing flow of the heat transfer medium into the channel 780C.

Example 8

Figure 34:
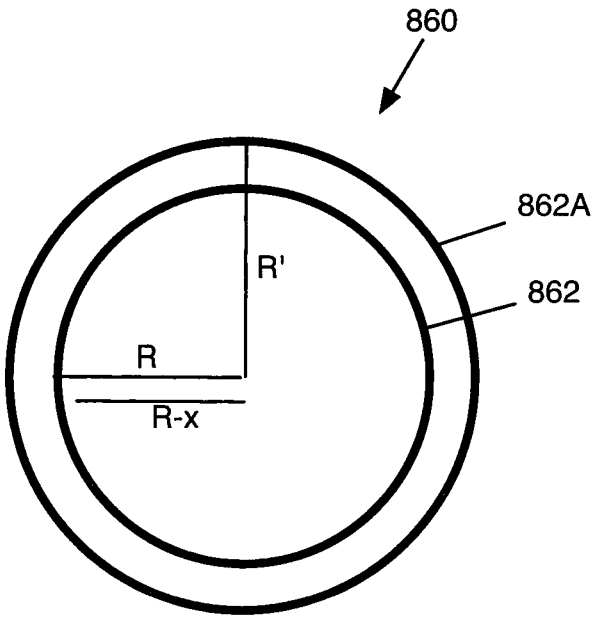
FIG. 34 shows a cross-sectional schematic of a general aspect of various embodiments of the invention.

Finally, FIG. 34 shows a general view of a common aspect of the various embodiments of the invention in FIGS. 25-33. A conduit 860 comprising a pass 862 having a radius R and pass housing 862A having a radius R' are shown. Typically, a hot fluid resides within the pass 862 and a heat transfer medium between the pass 862 and the pass housing 862A (i.e., in an area between R and R'. In each of EXAMPLES 5-7, at least a portion of the heat transfer medium is directed, within a fin, to an area between R and R-x, where x is a positive value. That is, a portion of the heat transfer medium is moved, within a fin, to an area within the radius of the pass 862, which, as noted above, contains the hot fluid. Such arrangements improve heat transfer from the hot fluid to the heat transfer medium.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A device for transferring heat from a fluid to a heat transfer medium comprising:

a vessel capable of containing the heat transfer medium;

a conduit extending through a wall of the vessel, the conduit having a first surface for contacting the heat transfer medium and a second surface for contacting a fluid within the conduit;

a helical member residing around and along a length of the first surface of the conduit capable of angularly directing a flow of the heat transfer medium along the first surface of the conduit; and a plurality of hollow fins helically arranged adjacent the helical member, each hollow fin having a body extending through a wall of the conduit and a void within the body, such that the void extends to a point within a radius of the conduit, such that the body is in contact with the fluid and the void is in contact with the heat transfer medium, wherein heat is transferred from the fluid to the heat transfer medium via the plurality of fins.

2. The device of claim 1, further comprising:

at least one baffle for directing the heat transfer medium to an area within at least one of the plurality of fins.

3. The device of claim 1, wherein at least one of the plurality of fins includes:

a tail residing within the radius of the conduit.

4. The device of claim 1, wherein the at least one of the plurality of fins further includes a baffle for directing at least a portion of the heat transfer medium into the void.

5. The device of claim 1, wherein the void comprises a channel extending from a first side of the body to a second side of the body.

6. The device of claim 1, wherein at least one of the plurality of fins is oriented at an angle relative to the longitudinal and radial axes of the conduit.

7. The device of claim 1, wherein at least one of the plurality of fins comprises a tube, wherein the heat transfer medium flows within the tube and the fluid flows around the tube, and wherein heat is transferred from the fluid to the heat transfer medium via the tube.

8. A device for transferring heat from a fluid to a heat transfer medium comprising:

a vessel capable of containing the heat transfer medium;

a conduit extending through a wall of the vessel, the conduit having a first surface for contacting the heat transfer medium and a second surface for contacting a fluid within the conduit;

a plurality of hollow fins helically arranged around and along a length of the first surface of the conduit, each hollow fin having a body extending through a wall of the conduit and a void within the body, such that the void extends to a point within a radius of the conduit, such that the body is in contact with the fluid and the void is in contact with the heat transfer medium wherein heat is transferred from the fluid to the heat transfer medium via the plurality of fins.

9. The device of claim 8, further comprising:

at least one baffle for directing the heat transfer medium to a void of at least one of the plurality of fins.

10. The device of claim 8, wherein at least one of the plurality of fins includes:

a tail residing within the radius of the conduit.

11. The device of claim 8, wherein the at least one of the plurality of fins further includes a baffle for directing at least a portion of the heat transfer medium into the void.

12. The device of claim 8, wherein the void comprises a channel extending from a first side of the body to a second side of the body.

13. The device of claim 8, wherein at least one of the plurality of fins comprises a tube, wherein the heat transfer medium flows within the tube and the fluid flows around the tube, and wherein heat is transferred from the fluid to the heat transfer medium via the tube.

* * * * *